US010578007B2

(12) United States Patent
Lee

(10) Patent No.: US 10,578,007 B2
(45) Date of Patent: Mar. 3, 2020

(54) COOLANT CONTROL VALVE UNIT, AND COOLING SYSTEM HAVING THE SAME

(71) Applicants: Hyundai Motor Company, Seoul (KR); Kia Motors Corporation, Seoul (KR)

(72) Inventor: Hyo Jo Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/020,223

(22) Filed: Jun. 27, 2018

(65) Prior Publication Data

US 2019/0162106 A1 May 30, 2019

(30) Foreign Application Priority Data

Nov. 29, 2017 (KR) ..... 10-2017-0161361

(51) Int. Cl.
*F01P 7/16* (2006.01)
*F01P 3/02* (2006.01)
*F01P 7/14* (2006.01)

(52) U.S. Cl.
CPC ..... *F01P 7/165* (2013.01); *F01P 3/02* (2013.01); *F01P 2003/028* (2013.01); *F01P 2007/146* (2013.01); *F01P 2031/00* (2013.01); *F01P 2060/04* (2013.01); *F01P 2060/08* (2013.01); *F01P 2060/16* (2013.01); *F01P 2060/18* (2013.01)

(58) Field of Classification Search
CPC .... F01P 2007/146; F01P 7/16; F01P 2031/00; F01L 1/46; F16K 11/085; F16K 31/002; F16K 31/043; F16K 31/047
See application file for complete search history.

(56) References Cited

U.S. PATENT DOCUMENTS

| | | | | |
|---|---|---|---|---|
| 2013/0221116 | A1* | 8/2013 | Tsuchiya | F01P 7/14 236/34.5 |
| 2016/0273671 | A1* | 9/2016 | Chang | F01P 7/14 |
| 2017/0096929 | A1* | 4/2017 | Kaneko | F01P 3/20 |
| 2017/0122181 | A1* | 5/2017 | Murakami | F16K 31/041 |
| 2017/0321595 | A1* | 11/2017 | Jang | F01P 7/16 |

* cited by examiner

*Primary Examiner* — Long T Tran
(74) *Attorney, Agent, or Firm* — Mintz Levin Cohn Ferris Glovsky and Popeo, P.C.; Peter F. Corless

(57) ABSTRACT

A coolant control valve unit includes: a valve housing including a barrier rib where a coolant path and a fail-safe path are formed, the valve housing further including an exhaust path through which coolant exhausted through the coolant path passes; a valve disposed to open and close the coolant path; an actuator that opens or closes the coolant path by moving the valve; a flow guide extended from the barrier rib, of which an end is formed in a flow direction of the coolant in the exhaust path, and guiding a flow of coolant exhausted through the coolant path and a flow of coolant exhausted through the fail-safe path; and a fail-safe valve closing the fail-safe path by being inserted into the fail-safe path, while opening or closing the fail-safe path by a coolant temperature.

11 Claims, 5 Drawing Sheets

COOLANT CONTROL VALVE UNIT, AND COOLING SYSTEM HAVING THE SAME

CROSS-REFERENCE TO RELATED APPLICATION

This application claims under 35 U.S.C. § 119(a) the benefit of Korean Patent Application No. 10-2017-0161361 filed in the Korean Intellectual Property Office on Nov. 29, 2017, the entire contents of which are incorporated herein by reference.

BACKGROUND

(a) Technical Field

The present disclosure relates to a coolant control valve unit that can precisely control a temperature of a cooling target by controlling an amount of coolant, and an engine cooling system having the same.

(b) Description of the Related Art

An engine generates torque by combustion of fuel, and a combustion gas is exhausted to the outside through an exhaust line. In particular, coolant absorbs heat energy while circulating through the engine, and exhausts the absorbed heat energy to the outside through a radiator.

In general, when a coolant temperature of the engine is low, viscosity of oil is increased, and thus a frictional force is increased and fuel consumption is increased, thereby deteriorating quality of the exhaust gas.

In addition, when the coolant temperature of the engine is excessively increased, knocking may result, and thus ignition timing is adjusted to suppress the generation of knocking, and accordingly performance of the engine may be deteriorated. In addition, when lubricant is excessively heated, lubrication performance may be deteriorated.

Accordingly, a coolant control valve that controls several cooling elements through one valve unit may be used to maintain a temperature of the coolant in a specific portion of the engine to be high and maintain the coolant temperature of other portions of the engine to be low.

Meanwhile, considering a case that the coolant control valve unit is faulty and a case that the coolant is excessively heated, a fail-safe valve is provided, and the fail-safe valve has a mechanical thermostat structure that is operated by coolant temperature. In general, when the coolant temperature reaches 115° C., the fail-safe valve is opened to prevent overheating of the coolant.

However, there is a spatial limit in mounting of the fail-safe valve, and flow resistance of the coolant is increased due to the mounting structure of the fail-safe valve, thereby causing reduction of the flow amount.

The above information disclosed in this Background section is only for enhancement of understanding of the background of the disclosure and therefore it may contain information that does not form the prior art that is already known in this country to a person of ordinary skill in the art.

SUMMARY

The present disclosure provides a coolant control valve unit and an engine cooling system having the same to prevent reduction of a flow amount of coolant due to flow resistance of the coolant flowing toward a radiator when a fail-safe valve is opened, and to resolve a problem of a spatial limit in mounting of a fail-safe valve.

A coolant control valve unit according to an exemplary embodiment of the present disclosure includes: a valve housing including a barrier rib where a coolant path and a fail-safe path are formed, the valve housing further including an exhaust path through which coolant exhausted through the coolant path passes; a valve disposed to open and close the coolant path; an actuator that opens or closes the coolant path by moving the valve; a flow guide extended from the barrier rib, of which an end is formed in a flow direction of the coolant in the exhaust path, and guiding a flow of coolant exhausted through the coolant path and a flow of coolant exhausted through the fail-safe path; and a fail-safe valve closing the fail-safe path by being inserted into the fail-safe path, while opening or closing the fail-safe path by a coolant temperature.

The fail-safe valve may include: a piston rod of which one end is supported by the flow guide; a wax housing to which the other (i.e., another or an opposite) end of the piston rod is inserted, and filled with wax; and an elastic member pushing the wax housing toward the flow guide by applying elasticity for the wax housing to close the fail-safe path.

A rod groove where one end of the piston rod is mounted may be provided in one side of the flow guide.

The flow guide may be extended from the barrier rib between the coolant path and the fail-safe path.

The coolant path may include a first coolant path, a second coolant path, and a third coolant path formed in the barrier rib, and the valve may include a first valve, a second valve, and a third valve that respectively open and close the first coolant path, the second coolant path, and the third coolant path.

The coolant control valve unit according to the exemplary embodiment of the present disclosure may further include an elastic member that elastically supports the valve for the valve to close the coolant path.

An engine cooling system according to an exemplary embodiment of the present disclosure includes: a cylinder head that is disposed on a cylinder block; and a coolant control valve unit that receives coolant exhausted from the cylinder block and the cylinder head, and distributes the coolant to cooling parts, wherein the coolant control valve unit includes: a valve housing including a barrier rib where a coolant path and a fail-safe path are formed, the valve housing further including an exhaust path through which coolant exhausted through the coolant path passes; a valve disposed to open and close the coolant path; an actuator that opens or closes the coolant path by moving the valve; a flow guide extended from the barrier rib, of which an end is formed in a flow direction of the coolant in the exhaust path, and guiding a flow of coolant exhausted through the coolant path and a flow of coolant exhausted through the fail-safe path; and a fail-safe valve closing the fail-safe path by being inserted into the fail-safe path, while opening or closing the fail-safe path by a coolant temperature.

The coolant path may include a first coolant path, a second coolant path, and a third coolant path formed in the barrier rib, and the valve may include a first valve, a second valve, and a third valve that respectively open and close the first coolant path, the second coolant path, and the third coolant path.

The coolant path may include a first coolant path, a second coolant path, and a third coolant path formed in the barrier rib, the valve may include a first valve, a second valve, and a third valve that respectively open and close the first coolant path, the second coolant path, and the third coolant path, the cooling parts may include a low-pressure exhaust gas recirculation (EGR) cooler, a heater, an EGR valve, an oil cooler, and a radiator, the first coolant path may be connected with the low-pressure EGR cooler and the heater, the second coolant path may be connected with the EGR valve and the oil cooler, and the third coolant path may be connected with the radiator through the exhaust path.

The fail-safe valve may include: a piston rod of which one end is supported by the flow guide; a wax housing to which the other (i.e., another or an opposite) end of the piston rod is inserted, and filled with wax; and an elastic member pushing the wax housing toward the flow guide by applying elasticity for the wax housing to close the fail-safe path.

A rod groove where one end of the piston rod is mounted may be provided in one side of the flow guide.

The flow guide may be extended from the barrier rib between the coolant path and the fail-safe path.

The engine cooling system according to the exemplary embodiment of the present disclosure may further include an elastic member that elastically supports the valve for the valve to close the coolant path.

According to the exemplary embodiments of the present disclosure, a flow guide is provided at a middle of an exhaust path through which coolant flows to a radiator, and an upper end of a fail-safe valve is supported by the flow guide such that flow resistance of coolant flowing toward the radiator can be reduced and a mounting structure of the fail-safe valve can be enhanced.

DETAILED DESCRIPTION OF THE EMBODIMENTS

Figure 1:
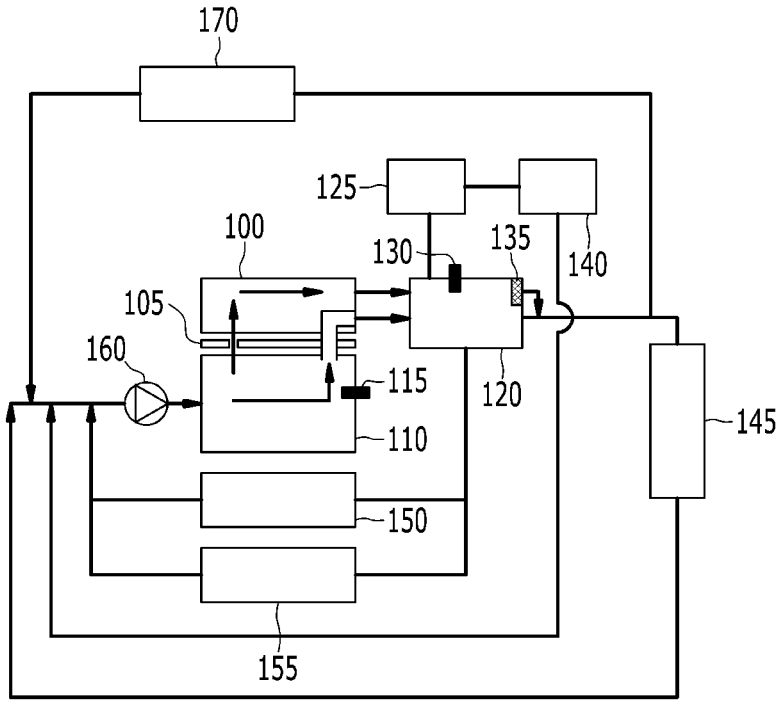
FIG. 1 is a schematic diagram of an engine cooling system according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, an exemplary embodiment of the present disclosure will be described in detail with reference to the accompanying drawings.

The drawings and description are to be regarded as illustrative in nature and not restrictive, and like reference numerals designate like elements throughout the specification.

FIG. 1 is a schematic diagram of an engine cooling system according to an exemplary embodiment of the present disclosure.

Referring to FIG. 1, an engine cooling system includes a cylinder head 100, a head gasket 105, a cylinder block 110, a block cooling temperature sensor 115, a coolant control valve unit 120, a valve cooling temperature sensor 130, a fail-safe valve 135, a reservoir tank 170, a low-pressure exhaust gas recirculation (EGR) cooler 125, a heater 140, a radiator 145, an EGR valve 150, an oil cooler 155, and a coolant pump 160.

The cylinder head 100 is disposed on the cylinder block 110, and the head gasket 105 is interposed therebetween.

The coolant pump 160 may be mounted on one side of the cylinder block 110, and the coolant control valve unit 120 may be disposed on the other side of the cylinder head 100.

Coolant pumped from the coolant pump 160 is supplied into one side of the interior of the cylinder block 110, and some of the coolant pumped to the cylinder block 110 is supplied into one side of the interior of the cylinder head 100 through the head gasket 105 and the rest of the coolant flows to the other side of the interior of the cylinder block 110.

The coolant flowed to the other side of the cylinder block 110 through the inside thereof passes through the head gasket 105, and thus may be supplied to the coolant control valve unit 120 engaged to the other side of the cylinder head 100.

The coolant supplied to one side of the interior of the cylinder head 100 flows to the other side of the interior of the cylinder head 100, and is thus supplied to the coolant control valve unit 120 mounted to the other side of the cylinder head 100.

The coolant control valve unit 120 may control coolant that is passed through the cylinder block 110 and then discharged, and the coolant passed through the cylinder head 100 and then discharged always circulates to the coolant control valve unit 120 according to operation of the coolant pump 160.

The block cooling temperature sensor 115 that senses a temperature of the coolant flowing therethrough is provided in the cylinder block 110, and the valve cooling temperature sensor 130 that senses a temperature of the coolant flowing therethrough is provided in the coolant control valve unit 120.

The coolant control valve unit 120 controls coolant distributed into the low-pressure EGR cooler 125 and the heater 140, controls coolant divided into the radiator 145, and always distributes the coolant to the low-pressure EGR cooler 125 and the oil cooler 155.

An EGR line (not shown) that is branched at a downstream side of a turbocharger (not shown) and then joined to an intake line is formed in the exhaust line, the low-pressure EGR cooler 125 is provided on the EGR line to cool a recirculated exhaust gas (i.e., EGR gas), and the heater 140 is provided to warm indoor air of the vehicle.

The radiator 145 is disposed to discharge heat of the coolant to the outside, the EGR valve 150 controls the flow amount of EGR gas provided in the EGR line, and the oil cooler 155 is disposed to cool oil that circulates through the engine.

The reservoir tank 170 is disposed on an additional line that is branched from a coolant line that is connected to the radiator 145 from the coolant control valve unit 120, and the reservoir tank 170 collects air contained in the coolant or replenishes the coolant with the cooling system.

The fail-safe valve 135 is a mechanical thermostat that is operated depending on a coolant temperature, and when the coolant control valve unit 120 fails and thus the coolant temperature is excessively increased, a bypass path connected to the radiator 145 is opened. Thus, when the fail-safe valve 135 operates, the coolant circulates to the radiator 145.

In the exemplary embodiment of the present disclosure, coolant parts are constituent elements where the coolant is substantially used, and the coolant parts may include the cylinder head 100, the cylinder block 110, the oil cooler 155, the EGR cooler 125, the heater 140, the radiator 145, the oil cooler 155, and the EGR valve 150.

Figure 2:
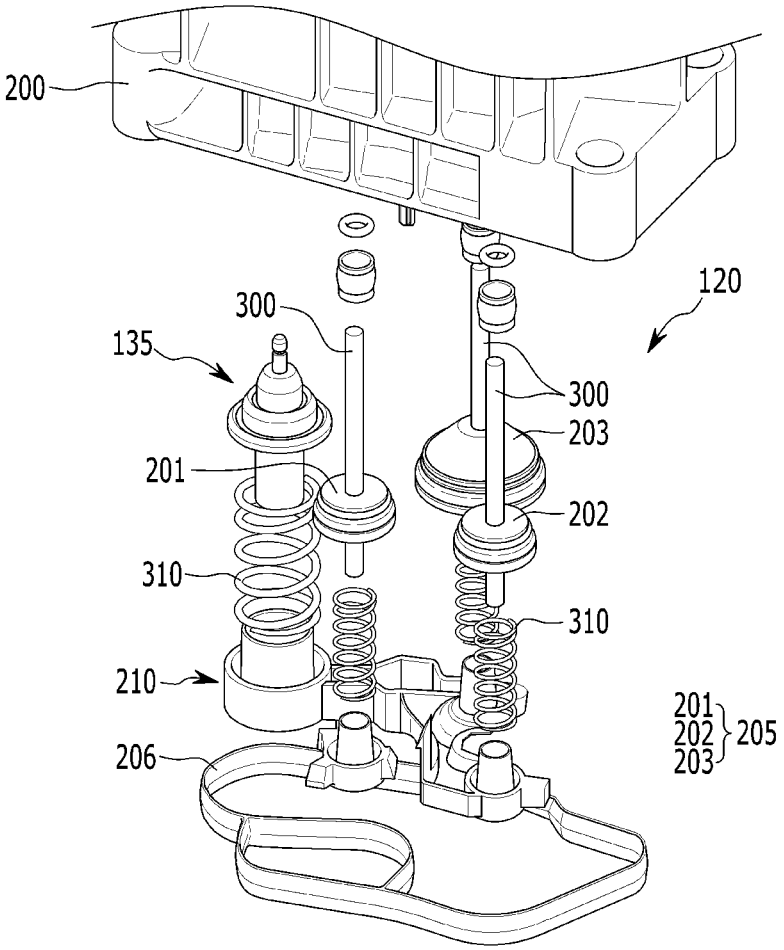
FIG. 2 is an exploded perspective view of the coolant control valve unit according to the exemplary embodiment of the present disclosure.

FIG. 2 is a partially exploded perspective view of the coolant control valve unit according to the exemplary embodiment of the present disclosure.

Referring to FIG. 2, the coolant control valve unit 120 includes a valve housing 200, the fail-safe valve 135, a valve 205, a stem 300, an elastic member 310, a supporting member 210, and a sealing member 206, and the valve 205 includes first, second, and third valves 201, 202, and 203.

The stem 300 is connected to an upper portion of each of the first, second, and third valves 201, 202, and 203, the elastic members 310 elastically support lower ends of the first, second, and third valves 201, 202, and 203 through upper portions thereof, the supporting member 210 supports lower ends of the elastic members 310, and the sealing member 206 is mounted to a mounting surface of the valve housing 200.

In the exemplary embodiment of the present disclosure, the valve 205 is formed of three valves, but the valve 205 may include one valve, two valves, or four valves, for example. That is, the number of valves 205 may be changed depending on a design specification.

Figure 5:
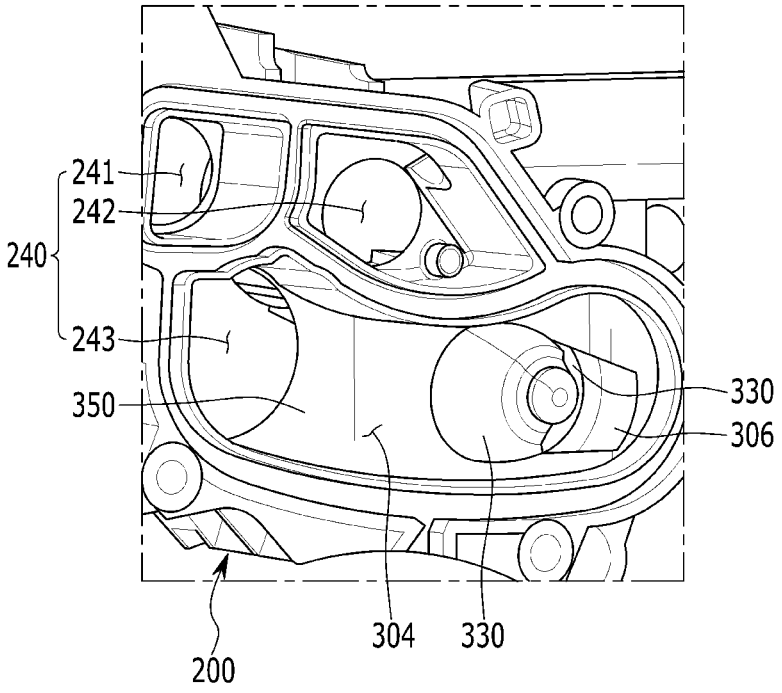
FIG. 5 is a partial perspective view of a valve housing of the coolant control valve unit according to the exemplary embodiment of the present disclosure.

FIG. 5 is a partial perspective view of a valve housing of the coolant control valve unit according to the exemplary embodiment of the present disclosure.

Referring to FIG. 5, coolant paths 240 are formed in the valve housing 200. The coolant paths 240 are formed at predetermined locations while having a predetermined gap in a barrier rib 350 of the valve housing 200, and the coolant paths 240 include first, second, and third coolant paths 241, 242, and 243.

In the exemplary embodiment of the present disclosure, the coolant path 240 may include three coolant paths, two coolant paths, or one coolant path, for example, and the number of coolant paths may be changed depending on a design specification.

In addition, an exhaust path 304 and an exhaust hole 306 through which coolant passed through the third coolant path 243 is exhausted are formed, and a fail safe path 230 (see FIG. 3) is formed in the barrier rib 350 at a location corresponding to the exhaust path 304.

A flow guide 330 is formed corresponding to the fail-safe path 230, and the flow guide 330 extends from the barrier rib 350 corresponding to an edge of the fail safe path 230 at the side of the third coolant path 243, and is formed in a flow direction of the coolant that passes through the exhaust path 304.

In the exemplary embodiment of the present disclosure, the flow guide 330 has a structure that guides a flow of the coolant that passes through the exhaust path 304 and at the same time supports the fail-safe valve 135, and such a structure of the flow guide 330 will be described with reference to FIG. 3.

Figure 3:
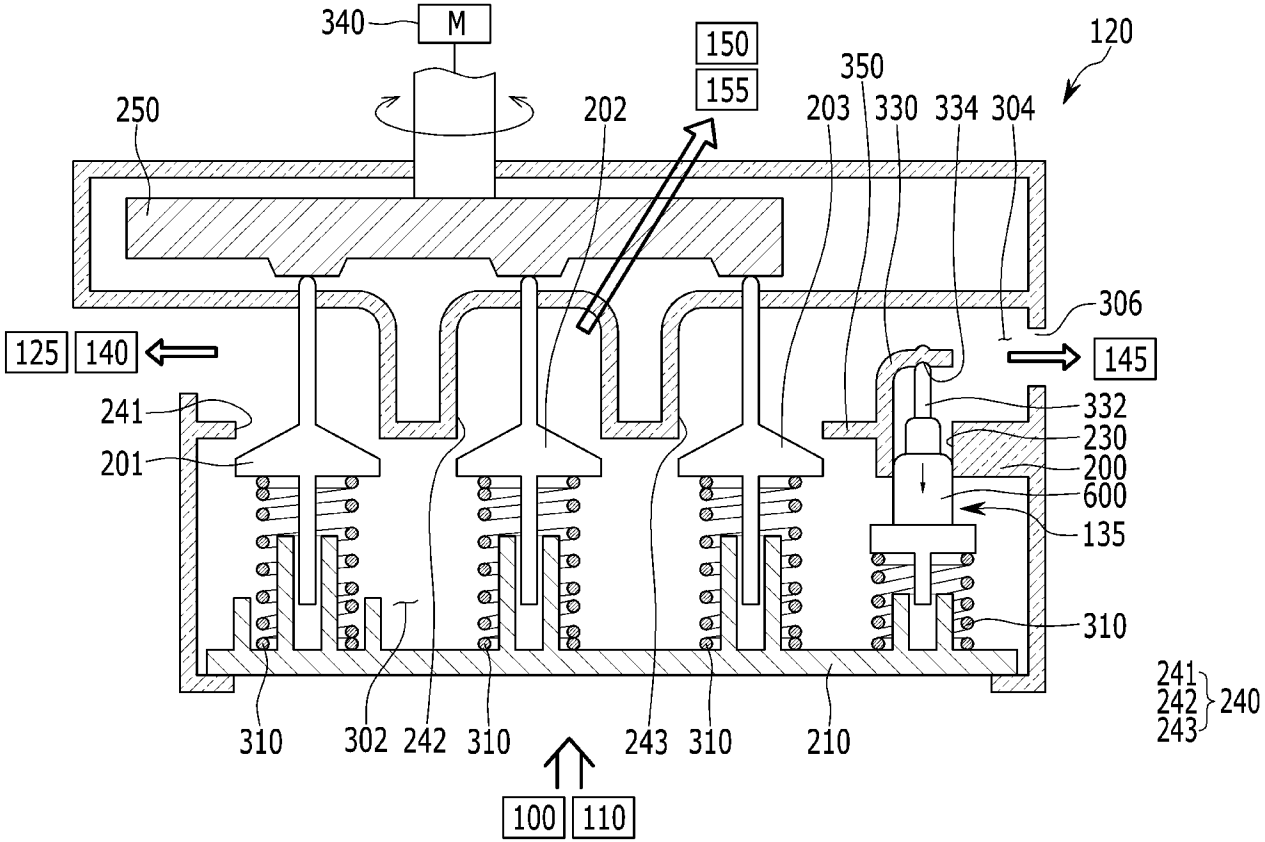
FIG. 3 is a cross-sectional view of a fail-safe path in a closed state in the coolant control valve unit according to the exemplary embodiment of the present disclosure.

FIG. 3 is a cross-sectional view of the fail safe path in a closed state in the coolant control valve unit according to the exemplary embodiment of the present disclosure.

Referring to FIG. 3, the coolant control valve unit 120 has a structure in which the valve 205 closes and opens the coolant path 240 and the fail-safe valve 135 opens and closes the fail-safe path 230.

Three coolant paths, that is, the first coolant path 241, the second coolant path 242, and the third coolant path 243 are formed in the barrier rib 350, and coolant exhausted through the third coolant path 243 is supplied to the radiator 145 through the exhaust path 304 and the exhaust hole 306.

Coolant exhausted through the first coolant path 241 is supplied to the low pressure EGR cooler 125 and the heater 140, and coolant exhausted through the second coolant path 242 is supplied to the EGR valve 150 and the oil cooler 155.

The first valve 201 is disposed to open and close the first coolant path 241, the second valve 202 is disposed to open and close the second coolant path 242, and the third valve 203 is disposed to open and close the third coolant path 243.

Referring to FIG. 3, a chamber 302 formed in an lower internal portion of the valve housing 200 is supplied with coolant from the cylinder head 100 and the cylinder block 110, and distributes the supplied coolant to coolant parts through the first, second, and third coolant paths 241, 242, and 243. The coolant parts include the above-stated parts.

The coolant passed through the third coolant path 243 is supplied to the radiator 145 through the exhaust path 304 and the exhaust hole 306, and the flow guide 330 is formed on the exhaust path 304.

An upper end of the fail-safe valve 135 is supported by the flow guide 330 and is disposed to open and close the fail-safe path 230, and the fail-safe path 230 is connected with the exhaust path 304.

In particular, the fail-safe valve 135 includes a piston rod 332 and a wax housing 600, and a bottom side of the wax housing 600 is supported by the elastic member 310 such that the wax housing 600 closes the fail-safe path 230.

A rod groove 334 is formed at a bottom side of the upper end of the flow guide 330, and an upper end of the piston rod 332 may be received in the rod groove 334.

Figure 4:
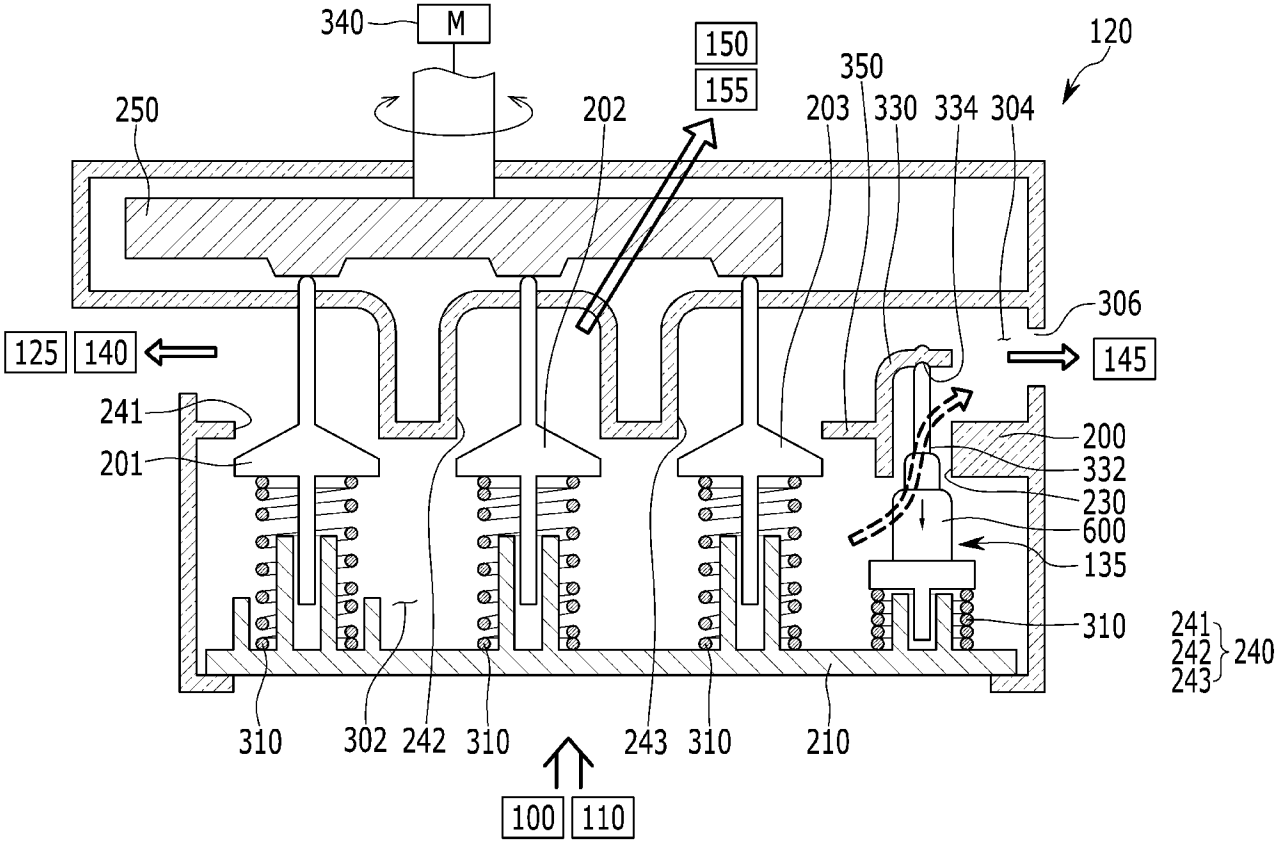
FIG. 4 is a cross-sectional view of the fail-safe path in an opened state in the coolant control valve unit according to the exemplary embodiment of the present disclosure.

FIG. 4 is a cross-sectional view of the fail-safe path in an opened state in the coolant control valve unit according to the exemplary embodiment of the present disclosure.

Referring to FIG. 4, when an internal temperature of the wax housing 600 is increased by a coolant temperature, wax in the wax housing 600 is expanded and thus pushes the piston rod 332 inserted in the wax housing 600, and the piston rod 332 is supported by the bottom side of the flow guide 330 such that the wax housing 600 descends while compressing the elastic member 310.

Accordingly, the fail-safe path 230 is opened, and the coolant circulates through the fail-safe path 230, the exhaust path 304, and the exhaust hole 306 to thereby prevent overheating of the coolant.

In the exemplary embodiment of the present disclosure, when an actuator 340 rotates a cam 250 by operation of the controller, the cam 250 selectively presses down the first, second, and third valves 201, 202, and 203 and thus the first, second, and third paths 241, 242, and 243 are opened. That is, it can be understood that the actuator 340 operates the respective valves 201, 202, and 203.

Accordingly, the flow guide 330 is disposed at a middle of the exhaust path 304 through which the coolant flows toward the radiator 145, and the upper end of the fail-safe valve 135 is supported by the flow guide 330 such that flow resistance of the coolant is reduced and a mounting structure of the fail-safe valve 135 can be enhanced.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A coolant control valve unit, comprising:

a valve housing including a barrier rib where a coolant path and a fail-safe path are formed, the valve housing further including an exhaust path through which coolant exhausted through the coolant path passes;

a valve disposed to open and close the coolant path;

an actuator that opens or closes the coolant path by moving the valve;

a flow guide extended from the barrier rib, of which an end is formed in a flow direction of the coolant in the exhaust path, and guiding a flow of coolant exhausted through the coolant path and a flow of coolant exhausted through the fail-safe path; and a fail-safe valve closing the fail-safe path by being inserted into the fail-safe path, while opening or closing the fail-safe path by a coolant temperature, wherein the coolant path comprises a first coolant path, a second coolant path, and a third coolant path formed in the barrier rib, and the valve comprises a first valve, a second valve, and a third valve that respectively open and close the first coolant path, the second coolant path, and the third coolant path.

2. The coolant control valve unit of claim 1, wherein the fail-safe valve comprises:

a piston rod of which one end is supported by the flow guide;

a wax housing to which another end of the piston rod is inserted, and filled with wax; and an elastic member pushing the wax housing toward the flow guide by applying elasticity for the wax housing to close the fail-safe path.

3. The coolant control valve unit of claim 2, wherein a rod groove where one end of the piston rod is mounted is provided in one side of the flow guide.

4. The coolant control valve unit of claim 1, wherein the flow guide is extended from the barrier rib between the coolant path and the fail-safe path.

5. The coolant control valve unit of claim 1, further comprising an elastic member that elastically supports the valve for the valve to close the coolant path.

6. An engine cooling system comprising:

a cylinder head that is disposed on a cylinder block; and a coolant control valve unit that receives coolant exhausted from the cylinder block and the cylinder head, and distributes the coolant to cooling parts, wherein the coolant control valve unit comprises:

a valve housing including a barrier rib where a coolant path and a fail-safe path are formed, the valve housing further including an exhaust path through which coolant exhausted through the coolant path passes;

a valve disposed to open and close the coolant path;

an actuator that opens or closes the coolant path by moving the valve;

a flow guide extended from the barrier rib, of which an end is formed in a flow direction of the coolant in the exhaust path, and guiding a flow of coolant exhausted through the coolant path and a flow of coolant exhausted through the fail-safe path; and a fail-safe valve closing the fail-safe path by being inserted into the fail-safe path, while opening or closing the fail-safe path by a coolant temperature, and wherein the coolant path comprises a first coolant path, a second coolant path, and a third coolant path formed in the barrier rib, and the valve comprises a first valve, a second valve, and a third valve that respectively open and close the first coolant path, the second coolant path, and the third coolant path.

7. The engine cooling system of claim 6, wherein:

the coolant path comprises a first coolant path, a second coolant path, and a third coolant path formed in the barrier rib, the valve comprises a first valve, a second valve, and a third valve that respectively open and close the first coolant path, the second coolant path, and the third coolant path, the cooling parts comprise a low-pressure exhaust gas recirculation (EGR) cooler, a heater, an EGR valve, an oil cooler, and a radiator, the first coolant path is connected with the low-pressure EGR cooler and the heater, the second coolant path is connected with the EGR valve and the oil cooler, and the third coolant path is connected with the radiator through the exhaust path.

8. The engine cooling system of claim 6, wherein the fail-safe valve comprises:

a piston rod of which one end is supported by the flow guide;

a wax housing to which another end of the piston rod is inserted, and filled with wax; and an elastic member pushing the wax housing toward the flow guide by applying elasticity for the wax housing to close the fail-safe path.

9. The engine cooling system of claim 8, wherein a rod groove where one end of the piston rod is mounted is provided in one side of the flow guide.

10. The engine cooling system of claim 6, wherein the flow guide is extended from the barrier rib between the coolant path and the fail-safe path.

11. The engine cooling system of claim 6, further comprising an elastic member that elastically supports the valve for the valve to close the coolant path.

* * * * *